US012760426B2

(12) United States Patent
Kofler et al.

(10) Patent No.: US 12,760,426 B2
(45) Date of Patent: Oct. 13, 2026

(54) INLINE SILICON DEPOSITION IN A PICKLING PLANT

(71) Applicant: Primetals Technologies Austria GmbH, Linz (AT)

(72) Inventors: Klaus Kofler, Linz (AT); Alois Stadlbauer, Engerwitzdorf (AT); Gerhard Frithum, Traiskirchen (AT)

(73) Assignee: Primetals Technologies Austria GmbH, Linz (AT)

( * ) Notice: Subject to any disclaimer, the term of this patent is extended or adjusted under 35 U.S.C. 154(b) by 229 days.

(21) Appl. No.: 18/287,908

(22) PCT Filed: Mar. 29, 2022

(86) PCT No.: PCT/EP2022/058240
§ 371 (c)(1),
(2) Date: Oct. 23, 2023

(87) PCT Pub. No.: WO2022/223248
PCT Pub. Date: Oct. 27, 2022

(65) Prior Publication Data

US 2024/0200202 A1 Jun. 20, 2024

(30) Foreign Application Priority Data

Apr. 23, 2021 (EP) ..... 21170036

(51) Int. Cl.
*C23G 1/36* (2006.01)
*B21B 45/02* (2006.01)
*C23G 1/00* (2006.01)

(52) U.S. Cl.
CPC ..... *C23G 1/36* (2013.01); *B21B 45/0287* (2013.01); *C23G 1/00* (2013.01)

(58) Field of Classification Search
CPC ..... B21B 45/0287; C23G 1/36; C23G 1/00
See application file for complete search history.

(56) References Cited

U.S. PATENT DOCUMENTS 5,344,572 A 9/1994 Wadhawan
9,139,916 B2 9/2015 Klein

FOREIGN PATENT DOCUMENTS

AT 411575 B 3/2004
CN 1082121 A 2/1994
(Continued)

OTHER PUBLICATIONS

Machine translation of JPS51123961A, dated Oct. 29, 1976. (Year: 1976).*

(Continued)

*Primary Examiner* — Michael E Barr
*Assistant Examiner* — Kevin G Lee
(74) *Attorney, Agent, or Firm* — Liang & Hennessey LLP; Brian Hennessey

(57) ABSTRACT

A device and a method for depositing undissolved materials, in particular undissolved silicon compounds, from a pickling fluid in a pickling plant. A pickling circuit of the pickling plant has a pickling tank for pickling metal strips, a return line between the pickling tank and a circuit tank, a circulation pump for circulating a main volume flow of pickling fluid from the pickling tank, and a heating device arranged in a pressure line between the circuit tank and the pickling tank. The device includes a flocculation device for introducing at least one flocculant into the main volume flow, and a deposition device in the circuit tank and preferably designed as an inclined clarifying device, for the sedimentation of undissolved materials directly from the main volume flow. When pickling silicon-containing steel strips (electrical steel strips), an at least two-stage flocculation can be carried out using two or more mixing zone containers.

10 Claims, 2 Drawing Sheets

(56) References Cited

FOREIGN PATENT DOCUMENTS

| | | | | | |
|---|---|---|---|---|---|
| CN | 1461823 | A | | 12/2003 | |
| CN | 1238562 | C | | 1/2006 | |
| CN | 202744634 | U | | 2/2013 | |
| CN | 202912712 | U | | 5/2013 | |
| CN | 206538270 | U | | 10/2017 | |
| CN | 206799309 | U | | 12/2017 | |
| CN | 110342684 | A | | 10/2019 | |
| CN | 112028372 | A | | 12/2020 | |
| CN | 212523126 | U | | 2/2021 | |
| DE | 4116353 | C1 | | 11/1992 | |
| DE | 4242619 | C2 | | 8/1994 | |
| EP | 0610505 | A1 | * | 8/1994 | ..... B01D 3/10 |
| JP | S51123961 | A | | 10/1976 | |
| JP | H06126322 | A | | 5/1994 | |
| JP | 2005200697 | A | * | 7/2005 | |
| JP | 2005298937 | A | * | 10/2005 | |
| RU | 2330902 | C2 | | 8/2008 | |
| RU | 2434975 | C2 | | 11/2011 | |
| RU | 2686890 | C1 | | 5/2019 | |
| SU | 1563760 | A1 | | 5/1990 | |
| WO | 2008141716 | A1 | | 11/2008 | |

OTHER PUBLICATIONS

Russian Office Action received in Russian Application No. 2023127042/05(059898) dated May 14, 2025, pp. 8.

Lokalov G.A et al.; "Axial and centrifugal pumps of thermal power plants"; 2016; pp. 9, 32. 83; 0.

European Search Report received in European Application No. 21170036.4 dated Sep. 30, 2021, 54 pages.

International Search Report and Written Opinion received in International Application No. PCT/EP2022/058240 dated Aug. 9, 2022, 17 pages.

Chinese Office Action received in Chinese Application No. 202280030245.1 dated Jul. 23, 2025, pp. 66.

Chinese Office Action received in Chinese Application No. 202280030245.1 dated Feb. 28, 2026, pp. 1-22.

Japanese Office Action received in Japanese Application No. 2023-564604 dated Mar. 4, 2025, pp. 7.

* cited by examiner

INLINE SILICON DEPOSITION IN A PICKLING PLANT

CROSS-REFERENCE TO RELATED APPLICATIONS

The present application is a national phase application of PCT Application No. PCT/EP2022/058240, filed Mar. 29, 2022, entitled "INLINE SILICON DEPOSITION IN A PICKLING PLANT", which claims the benefit of European Patent Application No. 21170036.4, filed Apr. 23, 2021, each of which is incorporated by reference in its entirety.

BACKGROUND OF THE INVENTION

1. Field of the Invention

The invention relates to a device and a method for depositing undissolved silicon compounds in a pickling circuit in a pickling plant.

2. Description of the Related Art

In a pickling plant, scale which is formed during a hot rolling process is removed from the surface of a rolled metal strip, for example a steel strip, in order to allow further processing of the metal strip. For this purpose, the scale layer is eroded by means of a suitable pickling fluid, for example a pickling solution containing hydrochloric acid (HCl) or sulfuric acid ($H_2SO_4$). Conventionally, the scaled metal strip is passed successively through a plurality of pickling containers. The scale layer (in the case of a steel strip primarily consisting of iron oxides) enters solution in the pickling fluid or insoluble constituents precipitate as so-called pickling sludge. The pickling sludge also contains chemical compounds of accompanying elements (for example carbon) and further alloy elements according to the composition of the original metal strip. After the pickling, residues of the pickling fluid that still adhere are generally cleaned off the descaled metal strip by washing with a washing fluid and the strip is then dried.

The spent pickling solution (referred to below as pickle liquor) is processed in a separate regeneration plant. The iron oxides thereby obtained constitute valuable chemical raw materials for the chemical industry, for which reason it is desirable to separate such oxides with the highest possible purity.

If steel strips having an elevated silicon content (i.e. with a silicon content of more than two percent by weight) are pickled in pickling plants based on hydrochloric acid, for example, an insoluble colloid in the form of a gel-like silicate sludge (silica) is formed in the pickling solution and can be separated only with great outlay. Steel strips having an elevated silicon content include in particular so-called electrical steel strips. The silicate sludge accumulates in tubes and other subsections of the pickling plant and leads to constant clogging or obstruction (so-called fouling), which in the worst case entails failure of the entire plant components. This also applies to other alloy constituents of the steel strips, for example Al, C etc., and also affects the regeneration plant.

In order to maintain the performance of the pickling plant, these accumulations need to be removed at regular time intervals, which is associated with a corresponding maintenance outlay. Customary methods for removing insoluble residues are on the one hand washing back the relevant subsections with a lye (for example sodium hydroxide—NaOH) and on the other hand mechanical removal of these residues manually. Both methods mean a reduction of the availability of the pickling plant. For washing back with a lye as a substance extraneous to the process, furthermore, special expensive apparatuses are required or an associated concept for processing or disposal of this washing solution is needed.

A further method for eliminating accumulations consists in separation by microfiltration. Because of the process conditions (high pH or high temperature of the pickling fluid), the service lives of the membranes used therefor are short so that such methods are uneconomical. Furthermore, this type of filtration is only limitedly suitable for large volume flows since the microfilters used have a very small pore structure. For example, AT 411 575 B discloses a method for reducing the content of undesired accompanying elements—in particular silicon compounds (silica)—the resulting pickling fluid being pacified down in a settling container and subsequently cleaned with the aid of a cross-flow microfilter in a temperature range of 10-55° C. Although effective deposition of undesired colloids from the pickling fluids is possible in the manner described, besides the use of the aforementioned microfilters in a customary pickling plant for steel strips, the invention of AT 411 575 B would also require cooling of the pickling fluid to be cleaned, since in particular electrical steel strips are pickled in a relatively high temperature range of up to 90° C.

It is known from CN 1 238 562 C to deposit silicon compounds from a pickling fluid in a pickling plant. In this case, a volume flow of pickling fluid of the order of 3 to 15 cubic meters per hour is cooled to 60° C. by means of a heat exchanger before a first flocculation aid is added and stirred with the pickling fluid in a mixing tank. A second flocculation aid is then added, before the pickling fluid is subsequently transferred into a conical settling tank. Precipitating silicon compounds are suctioned from the bottom of the settling tank, and the clarified pickling fluid is skimmed off via an overflow weir and delivered back into the pickling plant.

It is known from JP 2005 200697 A to deposit silicon compounds from a pickling fluid in a pickling plant comprising a plurality of pickling tanks. A main volume flow of pickling fluid is respectively circulated between a pickling tank and a respective circuit tank or directly between the pickling tanks. The circuit tanks are connected to a common device for pickling fluid regeneration. The regenerated pickling fluid is returned from the relevant circuit tank via a respective heat exchanger into the pickling tank. Furthermore, at least one pickling tank or circuit tank is followed by a secondary circuit, by means of which pickling fluid is conveyed from the relevant pickling or circuit tank via a deposition device for silicon compounds back into the pickling or circuit tank. In the deposition device, silicon compounds from the pickling fluid conveyed in the secondary circuit are deposited with the aid of a flocculation device and a sedimentation tank.

It is known from DE 41 16 353 C1 to deposit amorphous and partly dissolved silicon from a treatment solution conveyed in the circuit for the chemical treatment of strips of an iron-silicon alloy without addition of flocculation aids. In this case, a part of the treatment solution containing silicon is drawn off and delivered to a reception container, in which the solution is subjected to pressure-driven membrane filtration. In this case, the filtrate substantially freed from the silicon is delivered back to the treatment fluid, while the solution concentrated in silicon is delivered back into the reception container and the solution highly concentrated in silicon is drawn off from the reception container and disposed of.

The prior art furthermore discloses pickling plants which have a plurality of pickling tanks, through which a metal strip to be pickled is successively passed, and in which each pickling tank is assigned its own pickling circuit in which the pickling fluid is heated and circulated. The concentration of dissolved and undissolved scale compounds is greatest in the first pickling tank through which the strip passes, and it decreases relative thereto in the subsequent pickling tanks. The total circulated volume flow of a pickling circuit is for example from 300 to 500 cubic meters per hour, and is referred to below as a main volume flow of the pickling circuit. A pickling circuit comprises at least the relevant pickling tank, a circuit tank, a circulation pump and a heating device, the pipeline running between the pickling tank and the circuit tank being referred to as a return line of the relevant pickling tank. The circuit tank has a greater volume than the assigned pickling tank (in general about two times the volume of the pickling tank) and is used during the pickling operations as a so-called reception container which is filled only partly, for example to about 30-50%, with pickling fluid and the volume of which is also referred to below as the reception volume of the circuit tank. This reception volume serves as a buffer, for example in order to be able to compensate for variations in the filling level in the assigned pickling tank. Furthermore, the circuit tank is used to receive the pickling fluid from the assigned pickling tank during any emergency discharge, i.e. when the pickling fluid has to be released rapidly from the pickling tank, for example in the event of an operating interruption.

For the cleaning of pickling fluid in a pickling circuit, distinction is furthermore made between so-called inline operation and so-called offline operation. In the case of inline operation, at least one partial flow is taken from the main volume flow of a pickling circuit and delivered to a device for separating undissolved substances, for example undissolved silicon compounds. After the separation, the cleaned pickling fluid is delivered back into the pickling circuit. During offline operation, on the other hand, a part of the pickling fluid is first delivered to a device for separating undissolved substances and the pickling fluid from which undissolved substances have been cleaned is subsequently delivered to another regeneration plant for separating dissolved constituents (for example iron chloride compounds). Correspondingly, during inline operation, accumulations of undissolved substances in the plant components of the pickling plant itself are at least partially prevented (according to the ratio of the partial flow to the main volume flow), while during offline operation accumulations in the regeneration plant are fully prevented and the quality of the reusable material obtained from the regeneration plant is improved. Inline and offline operation may in principle be combined with one another.

The process conditions in a pickling tank are determined substantially by the main volume flow of the circulated pickling fluid and the process temperature $T_p$ of the latter. Besides the deposition of dissolved scale constituents, the circulation of the pickling fluid generates a flow of the pickling fluid in the respective pickling tank, which is necessary for the pickling process. Furthermore, heat losses of the pickling fluid in the respective pickling tank are compensated for by the heating device of the pickling circuit.

Especially for the pickling of aforementioned steel strips having a relatively large silicon content, pickling plants which have corresponding deposition devices for depositing the undissolved substances (for example silicon dioxide), incurred during the pickling, from the pickling fluid are furthermore known from the prior art. Although these inline deposition devices separate insoluble constituents from the pickling fluid during the inline operation, they deposit them only from a partial flow of the overall circulation flow in a pickling circuit and also require a device for cooling the partial flow. After the cleaning of the partial flow and before return into the pickling circuit, the amount of heat removed from the partial flow (in addition to the general heat loss during the pickling process) needs to be resupplied, which entails an increased energy consumption.

Furthermore, it is known from DE 42 42 619 C2 to deliver pickling fluid to be clarified, in particular pickling fluid from a hydrochloric acid pickling plant for electrical steel strips with a high silicon content, continuously from an acid reception container of the pickling plant initially to a preclarifying container and to deposit a large part of the suspended matter by means of sedimentation therein. Some of the partially clarified pickling fluid is subsequently delivered from the overflow region of the preclarifying container to an acid regeneration plant, while an acid-sludge mixture is drawn off from the bottom region of the preclarifying container at time intervals and subjected to a cleaning treatment with the aid of flocculation agents. Since the volume flows disclosed (of the order of a few cubic meters per hour) are much less than the volume flows of a conventional pickling circuit, the disclosed invention is not suitable for clarifying the main volume flow in the pickling circuit of a pickling plant. Furthermore, the additional container plus lines needed for the invention entail a significant space requirement.

A disadvantage with such methods and devices known from the prior art for depositing silicon compounds from a pickling fluid during inline operation is, on the one hand, the fact that undissolved substances are cleaned only from a part of the main volume flow. In the case of the pickling of steel strips with an elevated silicon content, the availability of such a pickling plant is therefore still significantly reduced because of the concomitant increased cleaning outlay in comparison with operation in which only strips without an elevated silicon content are pickled.

SUMMARY OF THE INVENTION

It is therefore an object of the present invention to overcome the disadvantages of the aforementioned systems and to improve significantly the availability of a pickling plant with only minor additional space requirement.

The object is achieved according to the invention by a device having the features disclosed herein.

A device according to the invention for depositing undissolved silicon compounds from a pickling fluid in a pickling plant having at least one pickling circuit has a flocculation device and a deposition device. The pickling circuit comprises a pickling tank of the pickling plant for pickling metal strips, a return line between the pickling tank and a circuit tank, and a pressure line between the circuit tank and the pickling tank. The pickling circuit furthermore comprises a circulation pump having a maximum pump capacity of from 500 to 600 cubic meters per hour for circulating a main volume flow of pickling fluid from the pickling tank through the return line into the circuit tank and via the pressure line back into the pickling tank, as well as a heating device arranged in the pressure line for heating the main volume flow passed through the pressure line to a process temperature $T_p$ prevailing in the pickling tank, which lies in a range of up to 90° C.

The expression "maximum pump capacity" refers to the amount of pickling fluid which the circulation pump can output, or circulate, per hour in continuous operation with maximum working performance. If necessary, the circulation pump may however also be operated with a lower working performance, so that a correspondingly smaller amount of pickling fluid is output by the pump per hour. By using the maximum pump capacity, the total amount of pickling fluid present in the pickling circuit may be circulated several times per hour, for example from 5 to 10 times per hour, and passed a corresponding number of times through the deposition device and thereby cleaned. The total amount of pickling fluid present in the pickling circuit in this case consists of the pickling fluid in the pickling tank, in the flocculation device, in the deposition device and in the return line and in the pressure line.

The flocculation device is preferably arranged in the return line and comprises one or more mixing zone containers for introducing at least one flocculation aid into the main volume flow. Alternatively, the flocculation device may also be arranged in the pickling tank or in the pressure line. The at least one flocculation aid introduced is in this case matched to the process temperature $T_p$ of the pickling fluid. The deposition device is arranged in the circuit tank of the pickling circuit and is configured to deposit undissolved silicon compounds directly from the main volume flow conveyed through the circuit tank.

By the device according to the invention, it is possible to carry out inline operation in which the deposition process for undissolved silicon compounds extends over the entire main volume flow, so that the pickling fluid for the pickling process is consequently made available in a consistent quality. Furthermore, in comparison with methods known from the prior art, energy can be saved since separate cooling and reheating of the pickling fluid to be cleaned is obviated and, because of the deposition device integrated into the circuit tank, only lower heat loss of the pickling fluid occur during the deposition of the undissolved substances.

Preferably, the circuit tank has a volume several times, for example two to three times, greater than the pickling tank in the relevant pickling circuit, the deposition device comprising at least a settling zone, a sedimentation zone and a reception zone. In this case, a first overflow is arranged between the settling zone and the sedimentation zone and a second overflow is arranged between the sedimentation zone and the reception zone.

An aforementioned volume of the circuit tank which is from two to three times greater than the volume of the pickling tank in the relevant pickling circuit makes it possible for the deposition device to be integrated directly into the circuit tank, so that the need for additional pipelines is obviated in comparison with a deposition device arranged outside a conventional circuit tank.

For example, a pickling tank has a volume of from 30 to 40 cubic meters and a circuit tank according to the invention has a volume of from 75 to 100 cubic meters. In this case, the sedimentation zone may be dimensioned to be large enough that the entire main volume flow of pickling fluid passing through the circuit tank during normal operation of the pickling plant has more than 90% of undissolved substances, in particular undissolved silicon compounds, cleaned from it so that the duration between necessary maintenance intervals on the pickling plant may be significantly increased.

In the settling zone, the turbulence created when the pickling fluid flows into the circuit tank can flow away so that the transfer of the pickling fluid into the subsequent sedimentation zone takes place in the form of a pacified flow, which is further assisted by the first overflow. The second overflow between the sedimentation zone and the reception zone prevents transfer of pickling sludge from the sedimentation zone into the subsequently arranged reception zone.

According to another preferred configuration of the device according to the invention, the flocculation device has at least two mixing zone containers for the addition of at least two different flocculation aids into the main volume flow of the pickling circuit. In this way, the type and concentration of the flocculation aid introduced into the main volume flow may respectively be adapted to the chemical composition of the metal strips currently being pickled in the pickling plant. For this purpose, the composition and concentration of the scale constituents in the pickling fluid may for example be carried out with the aid of a pickling model which takes into account the chemical composition of the metal strips and of the pickling fluid.

For example, with the aid of a plurality of mixing zone containers during the pickling of metal strips predominantly containing carbon, a first flocculation aid may merely be added in a first mixing zone container, while there is no addition in the other mixing zone containers. In another case—for example when steel strips containing silicon are pickled in the relevant pickling plant, the addition of the first flocculation aid in the first mixing zone container may be omitted while one-stage or multistage flocculation is carried out by means of one or more of the other mixing zone containers.

In one preferred configuration of the device according to the invention, the sum of the volumes of all the mixing zone containers is from 8 to 25 cubic meters. In this way, the residence time of the pickling fluid passed through is a few minutes (for example from 1 to 3 minutes) and it is possible to coagulate the undissolved silicon compounds in the pickling fluid with one another to form larger, or heavier, particles which settle more rapidly in the sedimentation zone.

Preferably, the deposition device is configured as a lamella separating device. Lamella separating devices comprise a multiplicity of mutually parallel flow channels through which the pickling fluid is passed, undissolved substances, for example undissolved silicon compounds, being deposited from the pickling fluid because of the effect of gravity in a sedimentation process. For this reason, lamella separating devices comprise no moving parts and consequently have long working times with relatively little maintenance outlay.

Preferably, the flow channels are inclined at an angle $\alpha$ relative to the vertical and consist of an acid-resistant and heat-resistant material which permanently withstands temperatures of at least 90° C. The angle $\alpha$ preferably lies in a range of 15-60°, particularly preferably in a range of 25-35°. Preferably, a normal distance d between neighboring flow channels (this means the distance between the centroids of the cross-sectional areas in a section plane normal to the longitudinal direction of the neighboring flow channels) is at least 50 mm, preferably at least 75 mm. In one particularly preferred configuration, in order to increase the mechanical stability, the lamella separating device is configured as a honeycomb arrangement of flow channels running parallel.

Lamella separating devices are known from the prior art, consist for example of a thermoplastic and may on the one hand be manufactured economically—for example with the aid of a 3D printing method—and adapted to any geometrical requirements; on the other hand, a lamella separating device having the aforementioned dimensions, with a fraction of the costs, is mechanically much more robust and at the same time less susceptible to obstructions by undissolved substances from the pickling fluid than, for example, microfilters used in the prior art.

The advantages and technical effects of the method according to the invention correspond to those of the device according to the invention. In the method according to the invention for depositing undissolved silicon compounds from a pickling fluid in at least one pickling circuit of a pickling plant, the pickling circuit includes:

- a pickling tank of the pickling plant for pickling metal strips,
- a return line between the pickling tank and a circuit tank,
- a pressure line between the circuit tank and the pickling tank,
- a circulation pump and
- a heating device arranged in the pressure line,
- a main volume flow of from 500 to 600 cubic meters per hour of pickling fluid is circulated by means of the circulation pump from the pickling tank through the return line into the circuit tank and via the pressure line back into the pickling tank,
- at least one flocculation aid is introduced into the main volume flow by means of a flocculation device having one or more mixing zone containers,
- undissolved silicon compounds are deposited directly from the main volume flow by means of a deposition device arranged in the circuit tank, and
- the main volume flow is heated to a process temperature $T_p$ by means of the heating device.

The method according to the invention for depositing undissolved silicon compounds from a pickling fluid is preferably carried out during the pickling of metal strips in the relevant pickling plant. As an alternative thereto, the method according to the invention may however also be used at a time when metal strips are not being pickled in the pickling plant, for example in order to clean the corresponding undissolved pickling residues particularly thoroughly from the pickling fluid after the pickling of a number of metal strips having an elevated silicon content. In this case as well, the main volume flow of a pickling circuit is circulated with the aid of the circulation pump.

In one configuration of the method according to the invention,

- when pickling a first type of metal strips by means of a first mixing zone container, a first flocculation aid is introduced into the main volume flow, and
- when pickling a second type of metal strips exclusively by means of a second and/or a third mixing zone container, at least a second flocculation aid is introduced into the main volume flow.

In other words: when pickling a first type of metal strips, a first flocculation aid is introduced into the main volume flow by means of a first mixing zone container, while the addition of further flocculation aids in a second and third mixing zone container is omitted so that the main volume flow only flows passively through the latter. When pickling a second type of metal strips—that is to say a type different to the first type—the addition of a flocculation aid in the first mixing zone container is omitted, while either only a second flocculation aid is added in a second mixing zone container or a second and a third flocculation aid are added into the main volume flow both in a second and in a third mixing zone container.

The first type of metal strips may for example include steel strips having a particular carbon content, while the second type may comprise steel strips having a high silicon content (and/or other insoluble alloy elements of the steel strip).

BRIEF DESCRIPTION OF THE DRAWINGS

The above-described properties, features and advantages of this invention, as well as the way in which they are achieved, will become clearer and more comprehensible in connection with the following description of exemplary embodiments, which are explained in more detail in connection with the drawings. Details which are the same are respectively denoted by the same references in all the figures.

DETAILED DESCRIPTION

Figure 1:
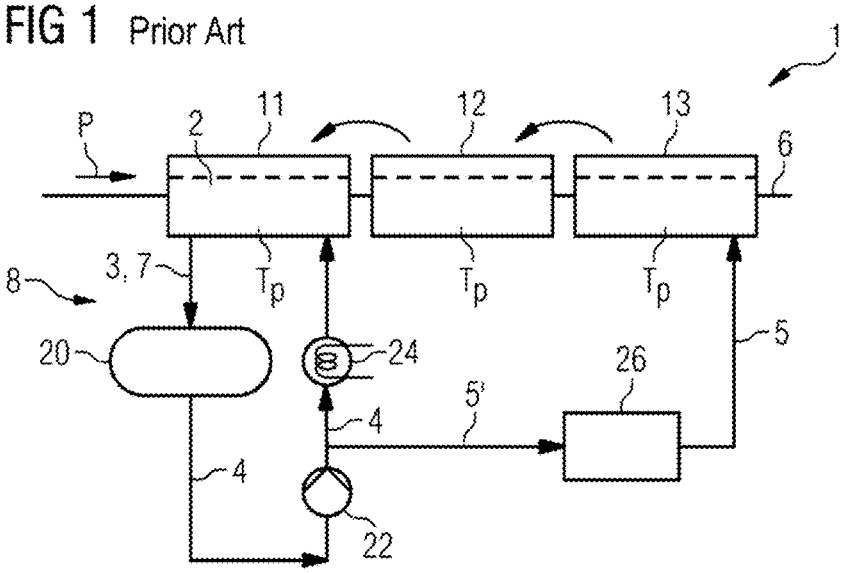
FIG 1 Prior Art
FIG. 1 shows a schematic representation of a simple pickling circuit, known from the prior art, of a pickling plant.

FIG. 1 (FIG. 1) schematically shows a pickling plant 1 comprising three pickling tanks 11, 12 and 13, which are respectively filled with pickling fluid 2 and through which a metal strip 6 to be pickled passes successively in a production direction P (symbolized in FIG. 1 by an arrow from left to right). Each pickling tank 11, 12, 13 is assigned its own pickling circuit 8, only the pickling circuit 8 of the first pickling tank 11 being represented in FIG. 1. In what follows, a connecting arrow between two subsections respectively symbolizes a connecting pipeline. Besides the pickling tank 11 itself, the pickling circuit 8 represented comprises a circuit tank 20, a circulation pump 22 and a heating device 24, these subsections being connected to one another in series via pipelines. A line running between the pickling tank 11 and circuit tank 20 is in this case referred to as a return line 3, and a line running between the circuit tank 20 and pickling tank 11 is referred to as a pressure line 4.

The pickling fluid 2 used in the pickling plant 1 is conveyed counter to the production direction P of the metal strip 6 through the individual pickling tanks 11, 12 and 13, fresh pickling fluid 2 being introduced into the last pickling tank 13 and conveyed in a cascade (symbolized in FIG. 1 by curved arrows between the individual pickling tanks 11, 12 and 13) counter to the production direction P to the first pickling tank 11. In this case, the concentration of dissolved substances (for example iron $Fe^{2+}$) and undissolved substances (for example silicon dioxide) increases in the pickling fluid 2. From the first pickling tank 11, pickling fluid 2 is first extracted via the return line 3 in the form of the so-called main volume flow 7 into the circuit tank 20, then a large part thereof is delivered by means of the circulation pump 22 via the heating device 24 and the pressure line 4 back to the pickling tank 11. A partial flow 5' is branched off from the pressure line 4 and delivered to processing in a regeneration plant 26. A partial flow 5 of reprocessed pickling fluid 2, corresponding to the withdrawn partial flow 5' and cleaned and heated to a conventional process temperature $T_p$ of up to 90° C. prevailing in the pickling tanks 11, 12 or 13, is delivered back to the last pickling tank 13.

The volume of the pickling tank 11, 12 or 13 is, for example, respectively from 30 to 40 cubic meters with a respective main volume flow 7 of, for example, up to 500 cubic meters per hour, the pipelines of the respective pickling circuit in total having an additional volume of about 10 cubic meters. The partial flow 5' branched off to the regeneration plant 26 is, for example, about 15 cubic meters per hour. During normal pickling operation, the circuit tank 20 is about one third filled with pickling fluid. In order to be able to collect the pickling fluid released from a pickling tank and the associated pipelines in the event of an emergency discharge, the associated circuit tank has a volume of about 70 cubic meters, for example.

Figure 2:
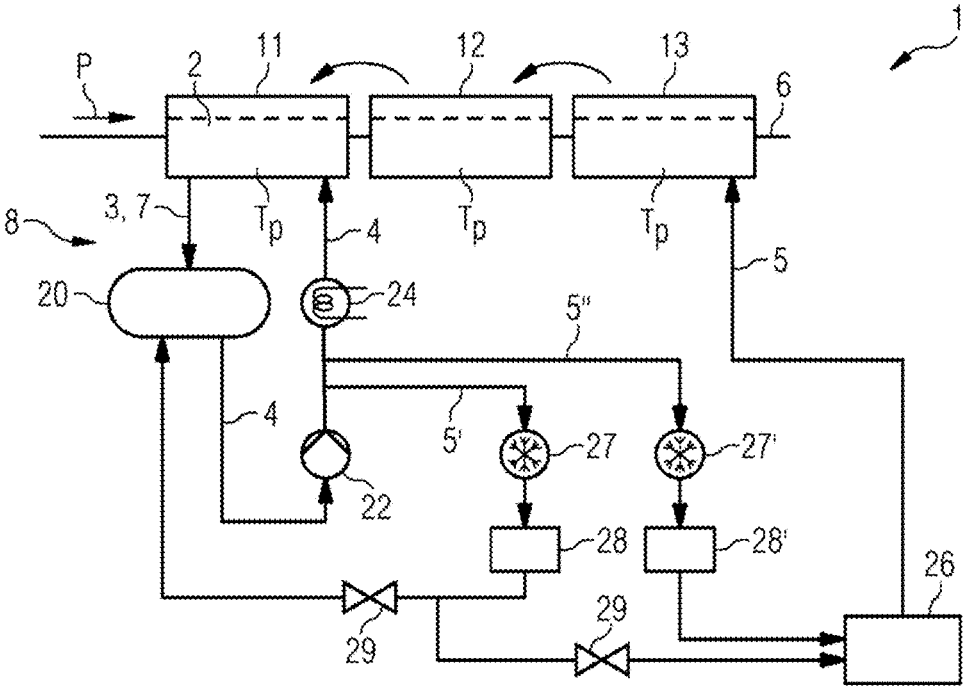
FIG 2 Prior Art
FIG. 2 shows a schematic representation of silicon deposition, known from the prior art, in a partial flow of the pickling circuit of a pickling plant.

FIG. 2 (FIG. 2) shows a pickling plant 1 known from the prior art for pickling steel strips 6 which contain an elevated silicon content (more than two percent by weight). In addition to the embodiment represented in FIG. 1, in the pickling plant 1 according to FIG. 2 a first partial flow 5' of pickling fluid 2 is branched off during inline or offline operation and a second partial flow 5" of pickling fluid 2 is branched off during offline operation from the pressure line 4 and respectively delivered via a cooling device 27 or 27' to a deposition device 28 or 28', respectively, for separating undissolved silicon compounds. The pickling fluid 2 of the partial flow 5', from which undissolved silicon compounds have been cleaned, is either during offline operation conveyed further via valves 29 into a regeneration plant 26 or, during inline operation, delivered back into the circuit tank 20.

Figure 3:
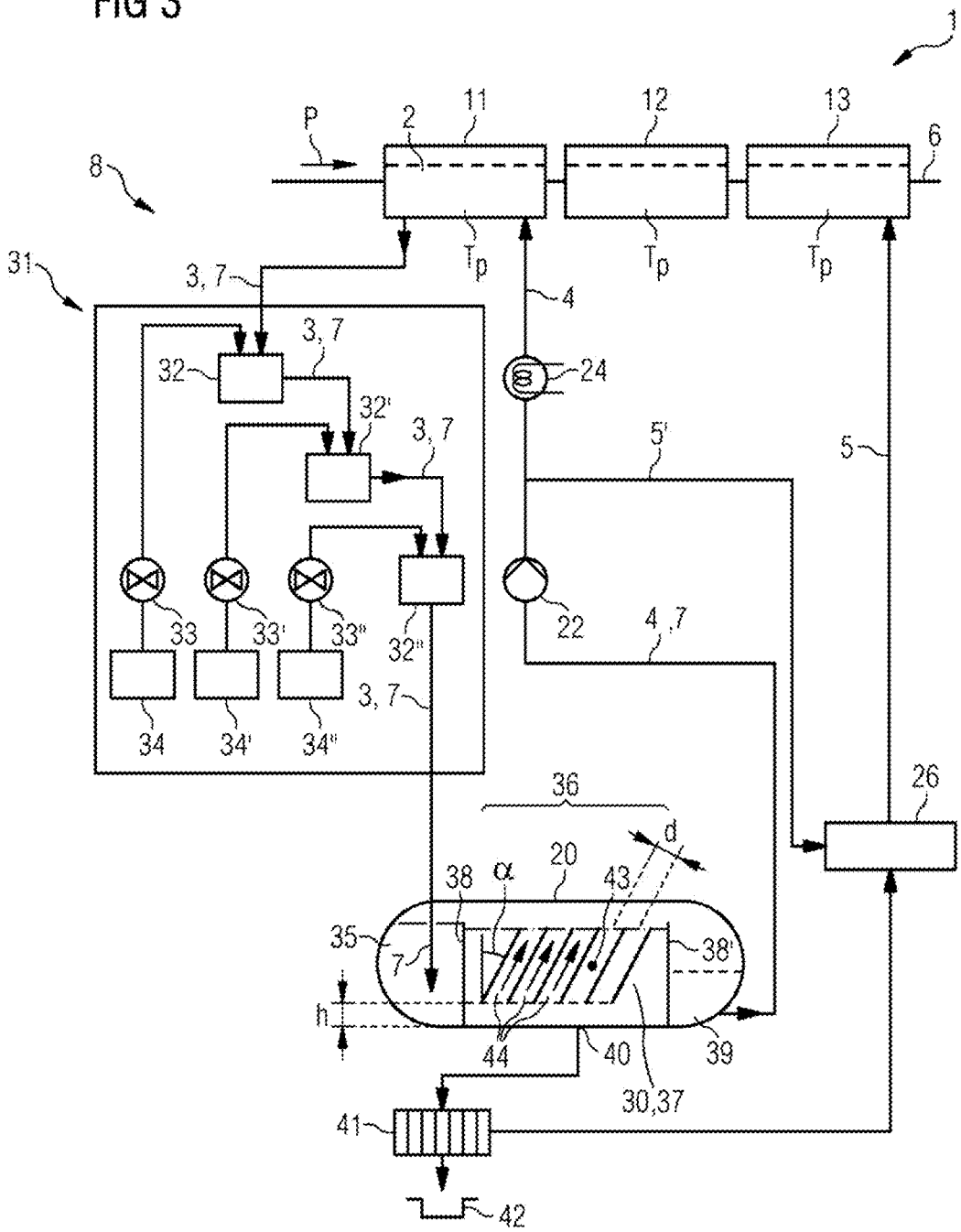
FIG. 3 shows an exemplary representation of a pickling circuit having a device according to the invention, comprising a deposition device in the circuit tank.

FIG. 3 (FIG. 3) shows by way of example and schematically a pickling circuit 8 of a pickling tank 11 having a flocculation device 31 and a circuit tank 20, which comprises a deposition device 30 according to the invention for depositing undissolved substances, preferably silicon compounds, from the pickling fluid 2. A pickling plant 1 comprising three pickling tanks 11, 12 and 13 is represented by way of example, although the invention may also be used for pickling plants having more or fewer than three pickling tanks.

According to FIG. 3, the deposition device 30 is arranged in the circuit tank 20 of the first pickling tank 11 since the pickling fluid 2 therein has the highest concentration of scale compounds formed during the pickling and there is therefore the greatest need for deposition thereof, in particular of undissolved silicon compounds, in this pickling circuit. The pickling circuits of the further pickling tanks 12 and 13 may also be configured as a conventional pickling circuit according to FIG. 1 because of their lower concentration of undissolved substances (this is not represented in FIG. 3). It is, however, also possible to configure several (for example the first two or three) or all of the pickling circuits of a pickling plant 1 with a deposition device 30 according to FIG. 3.

In FIG. 3, a metal strip 6 passes successively in the production direction P through three pickling tanks 11, 12 and 13 respectively filled with a pickling fluid 2. The pickling tanks 11, 12 and 13 respectively have a volume of about 30 to 40 cubic meters, and the connecting pipelines of the pickling circuit 8 have a total volume of about 10 cubic meters. From the first pickling tank 11, a main volume flow 7 of pickling fluid 2 comprising about 500 cubic meters per hour is conveyed out of the pickling tank 11 via the return line 3 and subsequently passes successively through three mixing zone containers 32, 32' and 32" of a flocculation device 31 arranged in the return line 3.

In the mixing zone containers 32, 32' and 32", the preparation of corresponding flocculation aids is respectively carried out with the aid of corresponding application devices 33, 33' and 33". For example, the respective flocculation aid is introduced in solid form from a corresponding storage container 34, 34' or 34" into the respective application device 33, 33' and 33" and dissolved in a liquid (for example water) so that it can be provided and introduced into the main volume flow 7 in the concentration required for the assigned mixing zone container 32, 32' and 32", in order to promote the sedimentation of the substances undissolved therein in a subsequent sedimentation zone 36. Alternatively, the respective flocculation aid may already be in concentrated liquid form in the respective storage container 34, 34' or 34" and diluted to a desired concentration in the respective application device 33, 33' and 33". As another alternative, the respective flocculation aid may also be introduced in solid form from the corresponding storage container 34, 34' or 34" directly by means of the respective application device 33, 33' or 33" into the respective mixing zone container 32, 32' or 32", the application device 33, 33' or 33" in this case being configured as a dosing device. If a flocculation aid is not added into the main volume flow 7 by one of the mixing zone containers 32, 32' or 32", the main volume flow 7 only flows passively through the corresponding mixing zone container 32, 32' or 32".

The transport of the pickling fluid 2 between the individual mixing zone containers 32, 32' and 32" may in this case take place either because of a natural gradient or with the aid of pumps (not represented in FIG. 3). In the exemplary embodiment according to FIG. 3, up to three different flocculation aids may be introduced in a respectively required concentration into the main volume flow 7 of the pickling circuit 8. The flocculation aids promote the coagulation of undissolved substances—for example undissolved silicon compounds—in the pickling fluid 2 to form larger particles 43, which can be deposited more easily with the aid of a subsequent deposition device 30 because of their size.

After the mixing zone containers 32, 32' and 32", the main volume flow 7 of the pickling circuit 8 is conveyed from the return line 3 into the circuit tank 20, which according to the invention comprises a settling zone 35, a sedimentation zone 36 and a reception zone 39 and has a total volume of from 75 to 100 cubic meters. The settling zone 35 is used to pacify the main volume flow 7 and minimize turbulence. Via a first overflow 38, the pacified pickling fluid 2 flows into the sedimentation zone 36 in which a deposition device 30 configured as a lamella separating device 37 is arranged.

The lamella separating device 37 has a multiplicity of flow channels 44 running parallel, which are arranged at a normal distance d of at least 50 to 70 mm next to one another and are inclined at an angle $\alpha$ relative to the vertical. In the flow channels, undissolved substances of the pickling fluid 2, which are coagulated to form particles 43, settle because of the effect of gravity in a sedimentation process in the direction of the bottom region of the sedimentation zone 36. The lower end of the flow channels 44 is separated in the vertical direction at a height h of at least 200 mm from the bottom level of the circuit tank 20. The flow channels 44 forming a flow direction (symbolized in FIG. 3 by arrows pointing obliquely upward) for the pickling fluid 2 passed through may be formed from tubes or hollow prisms arranged parallel to one another, which respectively have a closed boundary in a plane normal to the flow direction so that the lamella separating device 37 overall has a honeycomb structure (not visible in FIG. 3).

The pickling sludge which gathers in the bottom region of the sedimentation zone 36, or of the circuit tank 20, when the pickling fluid 2 flows through the lamella separating device 37 is extracted from there and delivered through an extraction opening 40 to a filtering device 41. The bottom of the circuit tank 20 is preferably configured in such a way that automatic transport of the sediment to the extraction opening 40 is ensured (for example by a corresponding chamfer or rounding in the bottom face; for example, the circuit tank 20 may be configured as a recumbent cylinder with rounded bottoms and a diameter of for example from 4 to 4.5 meters). Alternatively, the sediment may also be extracted from the circuit tank 20 by suitable conveyor devices (for example a pump, not represented in FIG. 3). In the filtering device 41, which is configured for example as a chamber filter press, the solid constituents of the pickling sludge are separated as a dry substance (filter cake) and delivered to a collection container 42 for the purpose of subsequent disposal, while the remaining liquid fraction of the pickling sludge (filtrate) is delivered to the regeneration plant 26.

Via a second overflow 38', the pickling fluid 2 from which undissolved substances have been cleaned flows into the reception zone 39 of the circuit tank 20, from where the main volume flow 7 is delivered back into the first pickling tank 11 with the aid of a circulation pump 22 via a pressure line 4. Arranged in the pressure line 4, there is a heating device 24 which heats the pickling fluid 2 passed through to a process temperature $T_p$ of generally up to 90° C. Before the heating device 24, a partial flow 5'—for example from 12 to 18 cubic meters per hour—is branched off from the main volume flow 7 and delivered to a regeneration plant 26.

LIST OF REFERENCE SIGNS

1 pickling plant
2 pickling fluid
3 return line
4 pressure line
5,5', 5" partial flow
6 metal strip
7 main volume flow
8 pickling circuit
11, 12, 13 pickling tank
20 circuit tank
22 circulation pump
24 heating device
26 regeneration plant
27, 27 cooling device
28, 28' deposition device
29 valve
30 deposition device
31 flocculation device
32, 32', 32" mixing zone container
33, 33', 33" application device
34, 34', 34" storage container
35 settling zone
36 sedimentation zone
37 lamella separating device
38, 38' overflow
39 reception zone
40 extraction opening
41 filtering device
42 collection container
43 particle
44 flow channel
d normal distance
h height
P production direction
$T_p$ process temperature
α angle

The invention claimed is:

1. A device for depositing undissolved silicon compounds from a pickling fluid in a pickling plant having at least one pickling circuit, the pickling circuit comprising:
- a pickling tank of the pickling plant for pickling metal strips;
- a return line between the pickling tank and a circuit tank;
- a pressure line between the circuit tank and the pickling tank;
- a circulation pump having a maximum pump capacity of from 500 to 600 cubic meters per hour for circulating a main volume flow of pickling fluid; and
- a heating device arranged in the pressure line for heating the main volume flow to a process temperature;
- wherein the device comprises:
  - a flocculation device having one or more mixing zone containers configured to introduce at least one flocculation aid into the main volume flow; and
  - a deposition device arranged in the circuit tank configured to deposit undissolved silicon compounds directly from the main volume flow;
- wherein the deposition device comprises at least a settling zone, a sedimentation zone, and a reception zone;
- wherein a first partition in the circuit tank is arranged between the settling zone and the sedimentation zone, the first partition configured to allow overflow between the settling zone and the sedimentation zone; and
- wherein a second partition in the circuit tank is arranged between the sedimentation zone and the reception zone, the second partition configured to allow overflow between the sedimentation zone and the reception zone.

2. The device as claimed in claim 1, wherein the circuit tank has a volume from 2 to 3 times greater than the pickling tank in the pickling circuit.

3. The device as claimed in claim 1, wherein the flocculation device has at least two mixing zone containers configured to add at least two different flocculation aids into the main volume flow.

4. The device as claimed in claim 1, wherein a sum of volumes of all of the mixing zone containers is from 8 to 25 cubic meters.

5. The device as claimed in claim 1, wherein the deposition device is configured as a lamella separating device comprising a multiplicity of mutually parallel flow channels.

6. The device as claimed in claim 5, wherein the flow channels are inclined at an angle relative to a vertical and consist of an acid-resistant and heat-resistant material which permanently withstands temperatures of at least 90° C.

7. The device as claimed in claim 6, wherein the angle is 15-60°.

8. The device as claimed in claim 6, wherein a normal distance between neighboring flow channels is at least 50 mm.

9. A method for depositing undissolved silicon compounds from a pickling fluid in at least one pickling circuit of a pickling plant, the pickling circuit comprising:
- a pickling tank of the pickling plant for pickling metal strips;
- a return line between the pickling tank and a circuit tank;
- a pressure line between the circuit tank and the pickling tank;
- a circulation pump; and a heating device arranged in the pressure line;

wherein the method comprises:

circulating, by the circulation pump, a main volume flow of from 500 to 600 cubic meters per hour of pickling fluid from the pickling tank through the return line into the circuit tank and via the pressure line back into the pickling tank;

introducing, by a flocculation device, at least one flocculation aid into the main volume flow having one or more mixing zone containers;

depositing, by a deposition device arranged in the circuit tank, undissolved silicon compounds directly from the main volume flow; and heating, by the heating device, the main volume flow to a process temperature;

wherein the deposition device comprises at least a settling zone, a sedimentation zone, and a reception zone;

wherein a first partition in the circuit tank is arranged between the settling zone and the sedimentation zone, the first partition configured to allow overflow between the settling zone and the sedimentation zone; and wherein a second partition in the circuit tank is arranged between the sedimentation zone and the reception zone, the second partition configured to allow overflow between the sedimentation zone and the reception zone.

10. The method as claimed in claim 9, wherein:

when pickling a first type of metal strips by means of a first mixing zone container, a first flocculation aid is introduced into the main volume flow; and when pickling a second type of metal strips exclusively by means of a second and/or a third mixing zone container, at least a second flocculation aid is introduced into the main volume flow.

* * * * *